United States Patent [19]

Biagini

[11] Patent Number: 4,700,549

[45] Date of Patent: Oct. 20, 1987

[54] ON-BOARD REFRIGERANT CHARGING SYSTEM

[75] Inventor: Guido Biagini, Cherry Valley, Ill.

[73] Assignee: Sundstrand Corporation, Rockford, Ill.

[21] Appl. No.: 872,872

[22] Filed: Jun. 11, 1986

[51] Int. Cl.[4] ..... F25B 45/00

[52] U.S. Cl. ..... 62/149; 62/292; 62/502

[58] Field of Search ..... 62/149, 174, 77, 114, 62/502, 292, 298, 299, 239; 417/429, 426

[56] References Cited

U.S. PATENT DOCUMENTS

| | | | |
|---|---|---|---|
| 2,893,217 | 7/1959 | Nigro | 62/126 |
| 3,400,552 | 9/1968 | Johnson et al. | 62/149 |
| 3,491,544 | 1/1970 | Webber | 62/77 |
| 3,668,882 | 6/1972 | Sarsten et al. | 62/77 |
| 3,695,055 | 10/1972 | Bruce | 62/292 X |
| 3,738,230 | 6/1973 | Censi | 417/429 |
| 3,813,893 | 6/1974 | Gemender et al. | 62/129 |
| 3,875,755 | 4/1975 | Anderson et al. | 62/77 |
| 4,106,306 | 8/1978 | Saunders | 62/149 |
| 4,114,448 | 9/1978 | Merritt | 73/362 AR |
| 4,245,480 | 1/1981 | Saunders | 62/149 |
| 4,367,637 | 1/1983 | Paulokat | 62/292 |
| 4,470,265 | 9/1984 | Correia | 62/77 |
| 4,539,817 | 9/1985 | Staggs et al. | 62/149 |

*Primary Examiner*—Harry Tanner

*Attorney, Agent, or Firm*—Wood, Dalton, Phillips, Mason & Rowe

[57] ABSTRACT

An on-board refrigerant charging system for a vapor cycle environmental control system in an aircraft or the like. A pair of accumulation chambers are provided for holding two different refrigerant components, each chamber including an outlet. A selectively operable valve is operatively associated with each chamber outlet. An inlet is provided to the vapor cycle environmental control system. A unitary dual-vaned pump is in fluid communication with the valves and the inlet to the environmental control system. A control senses refrigerant loss and the component mixture in the control system, and actuates the pumps to replace the refrigerant loss and operates the valves according to the desired component mixture charge.

9 Claims, 1 Drawing Figure

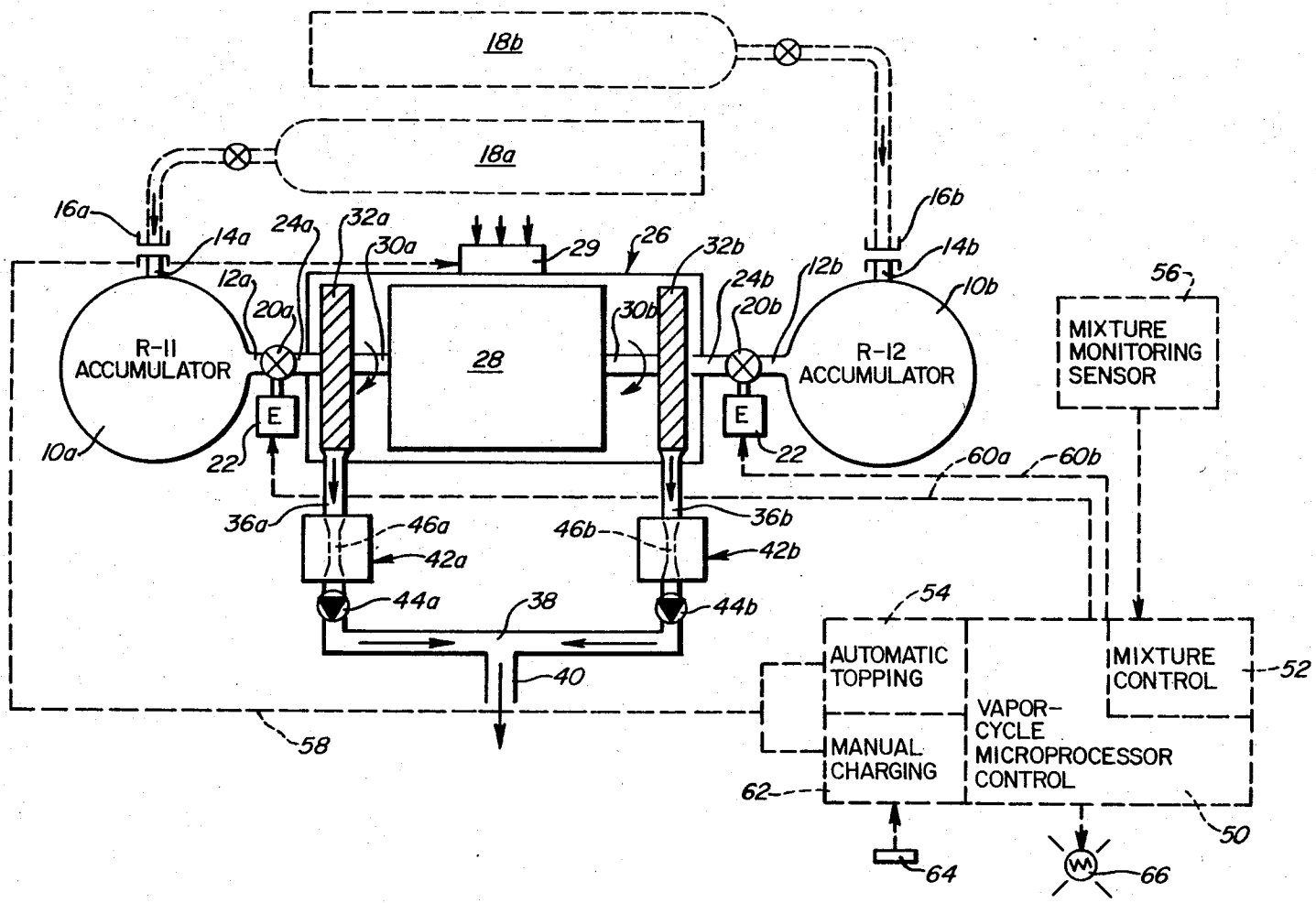
MIXTURE MONITORING SENSOR
MIXTURE CONTROL
VAPOR-CYCLE MICROPROCESSOR CONTROL
AUTOMATIC TOPPING
MANUAL CHARGING
R-12 ACCUMULATOR
R-11 ACCUMULATOR
E
E
52
50
56
66
60b
60a
54
64
62
16b
14b
10b
12b
22
24b
20b
32b
26
30b
29
28
18b
18a
36b
42b
44b
46b
38
40
46a
42a
44a
30a
32a
24a
20a
12a
14a
16a
10a
36a
58

ON-BOARD REFRIGERANT CHARGING SYSTEM

FIELD OF THE INVENTION

This invention generally relates to an on-board refrigerant charging system for a vapor cycle environmental control system in an aircraft or the like and, particularly, to an on-board charging system that compensates for refrigerant loss of a multi-component refrigerant.

BACKGROUND OF THE INVENTION

With the advent of advanced airborne cooling systems it has become quite important to provide a new approach to the requirements of maintenance, supportability and logistics. The principal problem is to support these high technology systems with personnel frequently possessing inadequate skill levels, to require fewer maintenance personnel and to reduce maintenance time and complexity.

In addition to ground or flight line challenges, there is a need for the highest possible probability of mission completion for the systems considered. In the case of vapor cycle environmental control systems, this essentially involves relative insensitivity to reasonable refrigerant leakage rates.

Heretofore, vapor cycle environmental control systems on aircraft predominantly have been charged and/or topped by charger/topper systems used primarily in ground applications. This is particularly true when the topper/charger involves a refrigerant composed of different components, such as a binary refrigerant mixture. Ground charging/topping procedures have been used primarily because of the varying ambient conditions experienced by the craft in flight, such as because of very cold temperatures and the resulting pressure differentials. Ground charging/topping is much easier to accomplish. However, it would be desirable to provide an on-board refrigerant charging system which can be initially charged on the ground and subsequently topped in flight. This invention is directed to providing such a system in the form of a new and improved airborne charger/topper design.

SUMMARY OF THE INVENTION

An object, therefore, of the invention is to provide a new and improved charger/topper system that automatically compensates for refrigerant loss in a multi-component refrigerant system in the form of an on-board refrigerant charging system for a vapor cycle environmental system on an aircraft or the like.

In the exemplary embodiment of the invention, the system generally includes means defining at least a pair of accumulation chambers for holding at least two different refrigerant components, each chamber including an outlet. Selectively operable valve means are provided operatively associated with each outlet. Inlet means are provided to the vapor cycle environmental control system. Pump means are provided in fluid communication with each valve means and the inlet means. Motor means are provided for driving the pump means. Control means are provided for sensing refrigerant loss and the component mixture in the control system, and for actuating the motor means to drive the pump means to replace the refrigerant loss and for operating the valve means according to the desired component mixture.

The motor means comprises a unitary dual-vaned pump driven conjointly by a single motor.

The preferred embodiment includes metering means in fluid communication between each pump means and the inlet means to the vapor cycle environmental control system. Each metering means has restriction means sized relative to the other metering means in accordance with the desired ratio of the component mixture.

Each accumulation chamber is provided with an inlet for filling or initially charging the respective chamber whereafter the on-board refrigerant charging system provides a topping system for the aircraft during flight.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawing, in which:

The FIGURE is a schematic illustration of the on-oard refrigerant charging/topping system of the invention.

DETAILED DESCRIPTION OF THE PREFERRED EMBODIMENT

Referring to the drawing in greater detail, the principal components of the on-board refrigerant charging/topping system of the invention is shown in full lines in the FIGURE, the monitoring and control means being shown substantially by dotted lines. The system is defined for a vapor cycle environmental control system in an aircraft or the like whereby the system can be initially charged on the ground and subsequently topped during airborne operations.

More particularly, the system includes means defining at least a pair of accumulation chambers 10*a* and 10*b* for holding two different refrigerant components, such as an R-11 refrigerant and a R-12 refrigerant in chambers 10*a* and 10*b*, respectively. Each accumulation chamber 10*a* and 10*b* has an outlet 12*a* and 12*b*, respectively. Each chamber has an inlet 14*a* and 14*b*, respectively. The inlets include appropriate coupling means 16*a* and 16*b*, respectively, for filling the chambers with respective refrigerants from appropriate sources 18*a* and 18*b*, such as pressurized bottles containing refrigerants R-11 and R-12, respectively. This initial charging is normally done on the ground or on flight lines.

Selectively operable valves 20*a* and 20*b* of the on-off type are provided in fluid communication with outlets 12*a* and 12*b*, respectively, from accumulation chambers 10*a* and 10*b*, respectively. The valves are operated by appropriate energizers or actuators 22. Fluid lines 24*a* and 24*b* lead from valves 20*a* and 20*b* (from accumulation chambers 10*a* and 10*b*, respectively) to a unitary dual-vaned pump, generally designated 26. The pump includes a single motor 28 having drive shafts 30*a* and 30*b* for driving pump vanes 32*a* and 32*b*. An electrical control box 29 is coupled to motor 28. It can be seen that pump vane 32*a* pumps refrigerant R-11 from accumulation chamber 10*a*, through outlet 12*a*, valve 20*a* and fluid line 24*a*. Pump vane 32*b* pumps refrigerant R-12 from accumulation chamber 10*b*, through outlet 12*b*, valve 20*b* and fluid line 24*b*. Fluid lines 36*a* and 36*b* lead from pump vanes 32*a* and 32*b*, respectively, to a T-shaped junction 38 which has a fluid line 40 defining inlet means to the vapor cycle environmental control system of the aircraft.

Metering means are provided in fluid communication between each pump 32*a*,32*b* and inlet means 40 to the vapor cycle environmental control system. More particularly, a metering device, generally designated 42*a* is provided in fluid line 36*a*, and a metering device, generally designated 42*b*, is provided in fluid line 36*b*. Check valves 44*a* and 44*b* b are provided downline of metering devices 42*a* and 42*b*, respectively.

Each metering device 42*a* and 42*b* is provided with a restriction 46*a* and 46*b*, respectively, to provide the metering function. The restrictions are sized relative to each other in accordance with the desired ratio of the component mixture, i.e. the particular percentages of the R-11 and R-12 refrigerants.

Control means are provided for sensing refrigerant loss and the component mixture in the vapor cycle environmental control system of the aircraft, and for actuating motor 28 to drive pump vanes 32*a*,32*b* to replace the refrigerant loss and for operating valves 20*a*,20*b* according to the desired component mixture ratio. More particularly, a vapor cycle microprocessor control 50 is coupled between a refrigerant mixture control 52 and an automatic topping control 54. Signals are fed to the control means by a refrigerant component mixture monitoring sensor 56. An intelligence line 58 leads from the control means to electrical control box 29 for actuating motor 28. Command signals are directed to energizers 22 of valves 20*a* and 20*b* through intelligence lines 60*a* and 60*b*, respectively. A manual charging control 62 may be provided and actuated by an actuator 64. A low charge warning bit message may be indicated by a warning light or other signal means 66.

The sensing means 56, in essence, is a double sensor which senses both the quantity of the charge and the kind or percentage of the mixture. The sensing means may be of various known systems. For instance, a density sensor may be utilized for determining the composition of the mixture to send a signal to microprocessor 50. The microprocessor determines how far the mixture is from a predetermined or "design" mixture and commands either one or both of valves 20*a*, 20*b* to be opened for a predetermined amount of time. In other words, the sensor first measures density and the microprocessor will determine the composition of the refrigerant component mixture to be added to the vapor cycle environmental control system. Density sensors are but one type of sensing means.

The sensing means also performs the dual function of sensing the quantity of the charge necessary and may be a mass flow sensor which essentially measures the amount of charge in the environmental control system. If outside a predetermined allowed tolerance, the microprocessor accordingly will be informed to inject or "top" the vapor cycle environmental control system. The mass flow sensor may work on the known natural frequency concept, or other known float, optical, isotope or other sensor may be employed.

In operation, once mixture monitoring sensing means 56 determines the quantity of the necessary charge and the ratio of the mixture, microprocessor 50 and mixture control 52 will actuate motor 28 through intelligence line 58 and electrical control box 29. The microprocessor also will command valves 20*a*, 20*b* to be respectively opened for a given period of time for admitting the desired mixture to the charge which may or may not be the same as the existing charge, as determined by sensing means 56.

It should be understood that the above described sensing and microprocessor control of the system is capable of completely charging the vapor cycle environmental control system with or without metering devices 42*a*,42*b*. However, by providing the metering devices, final adjustment of the mixture is minimized. In other words, the restrictions 46*a*,46*b* of the metering devices are preset to the desired mixture of the environmental control system. However, should sensing means 56 determine that the mixture of the necessary charge is different from the desired mixture, final adjustment is made as determined by the length of time in which either valves 20*a*,20*b* are maintained in open condition. The system of this invention is used primarily in a charging system that employs different refrigerants which are combined in a specific ratio one to the other in order that the resultant combined product is a non-azeotropic refrigerant mixture (NARM). Although a system for a binary mixture is illustrated, of course other multi-component refrigerant mixtures are contemplated.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An on-board refrigerant charging system for a vapor cycle environmental control system in an aircraft or the like, comprising:

means defining at least a pair of accumulation chambers for holding at least two different refrigerant components, each chamber including an outlet;

selectively operable valve means operatively associated with each outlet;

inlet means to the vapor cycle environmental control system;

pump means in fluid communication with each valve means and said inlet means;

metering means in fluid communication between each pump means and said inlet means;

motor means for driving the pump means; and control means for sensing refrigerant loss and the component mixture in the control system, and for actuating the motor means to drive the pump means to replace the refrigerant loss and for operating the valve means independently according to the desired component mixture charge.

2. The on-board refrigerant charging system of claim 1 wherein said motor means comprises a single motor for conjointly driving each pump means.

3. The on-board refrigerant charging system of claim 2 wherein said motor means and pump means comprise a unitary dual-vaned pump.

4. The on-board refrigerant charging system of claim 1 wherein each metering means has restriction means sized relative to the other metering means in accordance with the desired ratio of the component mixture.

5. The on-board refrigerant charging system of claim 1, including an inlet to each accumulation chamber for filling the respective chamber.

6. An on-board refrigerant charging system for a vapor cycle environmental control system in an aircraft or the like, comprising:

means defining at least a pair of accumulation chambers for holding at least two different refrigerant components, each chamber including an outlet;

selectively operable valve means operatively associated with each outlet;

inlet means to the vapor cycle environmental control system;

a unitary dual-vaned pump means including a pair of vaned pumps in fluid communication with respective ones of the valve means and said inlet means;

metering means in fluid communication between each pump means and said inlet means; and control means for sensing refrigerant loss and the component mixture in the control system, and for actuating the motor means to drive the pump means to replace the refrigerant loss and for operating the valve means independently according to the desired component mixture charge.

7. The on-board refrigerant charging system of claim 6 wherein each metering means has restriction means sized relative to the other metering means in accordance with the desired ratio of the component mixture.

8. The on-board refrigerant charging system of claim 6, including an inlet to each accumulation chamber for filling the respective chamber.

9. The on-board refrigerant charging system of claim 6 wherein said motor means comprises a single motor for conjointly driving both pumps.

* * * * *